US008961374B2

(12) United States Patent
Davidow et al.

(10) Patent No.: US 8,961,374 B2
(45) Date of Patent: Feb. 24, 2015

(54) HEALTH AID AND METHOD FOR TREATING PAIN

(75) Inventors: Robert Davidow, Palm Beach, FL (US); Stacey Bell, Bloomfield, NJ (US); Hiroko Davidow, Palm Beach, FL (US); Johnny Shealy, Greenacres, FL (US)

(73) Assignee: SHARE Solutions, LLC, Palm Beach, FL (US)

( * ) Notice: Subject to any disclaimer, the term of this patent is extended or adjusted under 35 U.S.C. 154(b) by 306 days.

(21) Appl. No.: 13/441,462

(22) Filed: Apr. 6, 2012

(65) Prior Publication Data

US 2012/0258842 A1 Oct. 11, 2012

Related U.S. Application Data

(60) Provisional application No. 61/473,416, filed on Apr. 8, 2011.

(51) Int. Cl.

| | |
|---|---|
| ***A63B 21/002*** | (2006.01) |
| ***A63B 26/00*** | (2006.01) |
| ***A63B 21/00*** | (2006.01) |
| ***A63B 23/02*** | (2006.01) |
| ***A63B 23/025*** | (2006.01) |

(52) U.S. Cl.

CPC ..... *A63B 21/00054* (2013.01); *A63B 23/0238* (2013.01); *A63B 23/025* (2013.01); *A63B 21/00047* (2013.01); *A63B 2208/0295* (2013.01); *A63B 2225/09* (2013.01); *A63B 2225/093* (2013.01)

USPC ..... 482/91; 482/142; 482/144

(58) Field of Classification Search

CPC .. A63B 23/02; A63B 26/00; A63B 21/00054; A63B 21/00109; A63B 21/1407; E05C 17/54; F41C 27/00; A61H 1/0296

USPC ..... 482/91, 142–144; 292/338–339

See application file for complete search history.

(56) References Cited

U.S. PATENT DOCUMENTS

| | | | | | |
|---|---|---|---|---|---|
| 1,304,394 | A | * | 5/1919 | Shyer | 292/338 |
| 2,543,729 | A | * | 2/1951 | Magida | 482/118 |
| 2,725,232 | A | * | 11/1955 | Magida | 482/118 |
| 2,756,618 | A | * | 7/1956 | Reaser | 81/15.9 |
| 2,768,668 | A | * | 10/1956 | Santosuosso | 206/315.7 |
| 3,173,415 | A | | 3/1965 | Rubin | |
| 3,235,997 | A | * | 2/1966 | Stoner | 42/94 |
| 3,340,611 | A | * | 9/1967 | Lauck | 30/124 |
| 3,591,173 | A | | 7/1971 | Cossman | |
| 3,679,203 | A | | 7/1972 | Grana | |
| 3,836,030 | A | * | 9/1974 | Timmons | 254/45 |
| 3,879,033 | A | | 4/1975 | Martin | |
| 4,023,796 | A | * | 5/1977 | Kusmer | 482/126 |
| D264,737 | S | | 6/1982 | Cooper | |
| 4,374,588 | A | * | 2/1983 | Ruggles | 482/118 |

(Continued)

*Primary Examiner* — LoAn H. Thanh
*Assistant Examiner* — Gary D Urbiel Goldner
(74) *Attorney, Agent, or Firm* — Duane Morris LLP; J. Rodman Steele, Jr.; Karen C. Kline

(57) ABSTRACT

A health aid and method for treating neck, shoulder and back pain including a first elongated member, a second elongated member, and an attachment connecting the first and second elongated members and configured for the first and second elongated members to move between an open position, wherein a bottom end of each of the first and second elongated members are separated by a first distance, and an engaged position, wherein the bottom ends are separated by a second distance that is less than the first distance.

8 Claims, 13 Drawing Sheets

(56) References Cited

U.S. PATENT DOCUMENTS

| | | | | | |
|---|---|---|---|---|---|
| 4,465,276 | A | | 8/1984 | Cox | |
| 4,880,203 | A | * | 11/1989 | Holcomb et al. | 249/24 |
| 5,121,624 | A | * | 6/1992 | Haughian | 72/409.19 |
| 5,290,209 | A | | 3/1994 | Wilkinson | |
| D356,137 | S | * | 3/1995 | Hull et al. | D22/108 |
| 5,403,269 | A | | 4/1995 | Kennedy | |
| 5,496,245 | A | | 3/1996 | Du Verney | |
| 5,518,485 | A | * | 5/1996 | Zislis | 482/131 |
| 5,569,141 | A | | 10/1996 | Chou | |
| D390,301 | S | * | 2/1998 | Peterson | D22/108 |
| 5,776,042 | A | | 7/1998 | Szabo | |
| 5,820,520 | A | * | 10/1998 | Sieber | 482/34 |
| 5,988,710 | A | * | 11/1999 | Kortschot et al. | 292/339 |
| 6,090,024 | A | | 7/2000 | Tsou | |
| 7,137,655 | B2 | * | 11/2006 | Quarberg | 292/339 |
| 7,426,800 | B2 | * | 9/2008 | Pierce et al. | 42/94 |
| D583,268 | S | * | 12/2008 | Chan | D10/106.1 |
| D634,796 | S | * | 3/2011 | Batiste et al. | D21/684 |
| 2006/0089239 | A1 | | 4/2006 | Davies, III | |

* cited by examiner

HEALTH AID AND METHOD FOR TREATING PAIN

CROSS-REFERENCE TO RELATED APPLICATIONS

This application claims priority to U.S. Provisional Patent Application No. 61/473,416 filed Apr. 8, 2011, the entirety of which is incorporated herein by reference.

FIELD OF THE INVENTION

The present invention relates generally to the field of health and, in particular, to a method and apparatus for treating pain including neck, shoulder and back pain.

BACKGROUND

The neck, shoulders and back contain muscles, bones, nerves, arteries, and veins, as well as many ligaments and other supporting structures. Many conditions can cause pain in these areas. Some are not so dangerous but very cumbersome such as simple strains or contusions.

The most common causes of shoulder, neck and/or back pain include an injury to the soft tissues, including the muscles, tendons, and ligaments within these structures; stress from overuse or misuse of the muscles; and/or habit-patterns in posture, which can cause an individual to tighten the muscles for an extended period of time. Injuries can occur from whiplash or other trauma to these areas, while stress and tension can be caused by overuse, misuse, and/or anxiety. Shoulder and neck pain can lead to a stiff neck or shoulder and loss of range of motion. Headaches and pain at the Tempero-Mandibular Joint (TMJ) may be other possible consequences.

Various methods and devices are known to be useful for treating neck, shoulder and back pain. Some treatments can be applied at home, such as rest, cold and heat therapy, and administration of pain medications, while other treatments may require professional assistance, such as immobilization, medical testing, and surgery or other hospitalization. While conventional methods and others of the prior art are useful in some instances, there are still numerous deficiencies and potential opportunities for new, improved and more effective health aid features and methods for treating pain.

SUMMARY OF THE INVENTION

One object of the health aid and associated methods described herein is to a new, improved and effective way to treat neck, shoulder and back pain.

A health aid and method for treating neck, shoulder and back pain is described. The health aid can include a first elongated member, a second elongated member, and an attachment connecting the first and second elongated members and configured for the first and second elongated members to move between an open position, wherein a bottom end of each of the first and second elongated members are separated by a first distance, and an engaged position, wherein the bottom ends are separated by a second distance. The second distance can be less than the first distance.

The health aid can also include a closed position wherein the bottom ends of the first and second elongated members are substantially adjacent with the first elongated member generally parallel to the second elongated member.

The attachment can connect the first and second elongated members proximate to a top end. The attachment can also include a pivotal attachment. The pivotal attachment can include a pin, screw, or hinge.

The attachment can also include a cap with a first elongated member receiving portion and a second elongated member receiving portion such that the first elongated member receiving portion can engage with the first elongated member proximate a top end and the second elongated member receiving portion can engage with the second elongated member proximate to a top end. The first and second elongated member receiving portions can also extend from an inside of the cap. The outside of the cap can also include an angled resting face for engagement with a substantially vertical surface.

The cap can also include a housing and first and second pins. The first pin can extend laterally across a first half of an inside of the housing and the second pin can extend laterally across a second half of the inside of the housing. The first elongated member can include a first aperture proximate to a top end for receiving the first pin and the second elongated member can include a second aperture proximate to a top end for receiving the second pin.

The health aid can also include a first securing foot connected to the bottom end of the first elongated member and a second securing foot connected to the bottom end of the second elongated member. Each of the first and second securing feet can also include a securing face for engagement with a substantially horizontal surface when the resting face on the cap engages with a substantially vertical surface. The securing faces can also include a corresponding angle to the resting face on the cap.

The health aid can also include telescoping elements, with the first elongated member including at least two first telescoping elements and the second elongated member including at least two second telescoping elements. The health aid can also include cushioning pieces, with a first cushioning piece connected to a bottom portion of the first elongated member and a second cushioning piece connected to a bottom portion of the second elongated member.

The method of treating neck, shoulder and back pain can include providing a health aid with a first elongated member, a second elongated member, and an attachment connecting the first and second elongated members and configured for the first and second elongated members to move between an open position and an engaged position; arranging the health aid at an angle with respect to a substantially horizontal plane; moving the health aid from the open position to the engaged position; and engaging the first and second elongated members of the health aid against a user's trapezius muscles.

Moving the health aid from the open position to the engaged position can also include arranging the health aid in the open position; inserting a user's neck between the first and second elongated members; and moving the first and second elongated members closer together wherein the first and second elongated members abut a user's trapezius muscles.

Engaging a user's trapezius muscles can also include engaging the first elongated member against a user's right trapezius muscles and engaging the second elongated member against a user's left trapezius muscles, and suspending the user's head in an inverted position. Engaging a user's trapezius muscles can also include stretching the trapezius muscles in a first direction and concurrently stretching the trapezius muscles in a second direction substantially opposite the first direction.

Arranging the health aid at an angle can also include an arrangement wherein a top end of the health aid engages with a substantially vertical surface and a bottom end of each of the first and second elongated members engage with a substantially horizontal surface. Arranging the health aid can also include engaging the resting face of the health aid with the substantially vertical surface. The substantially vertical surface can include a wall. The substantially horizontal surface can include a floor.

Arranging the health aid can alternately include an arrangement wherein an upper portion of the first and second elongated members rests against a raised surface and a bottom end of each of the first and second elongated members engages with a substantially horizontal surface.

These and other features, objects and advantages of the present invention will become more apparent to one skilled in the art from the following description and claims when read in light of the accompanying drawings.

DETAILED DESCRIPTION

Figure 1:
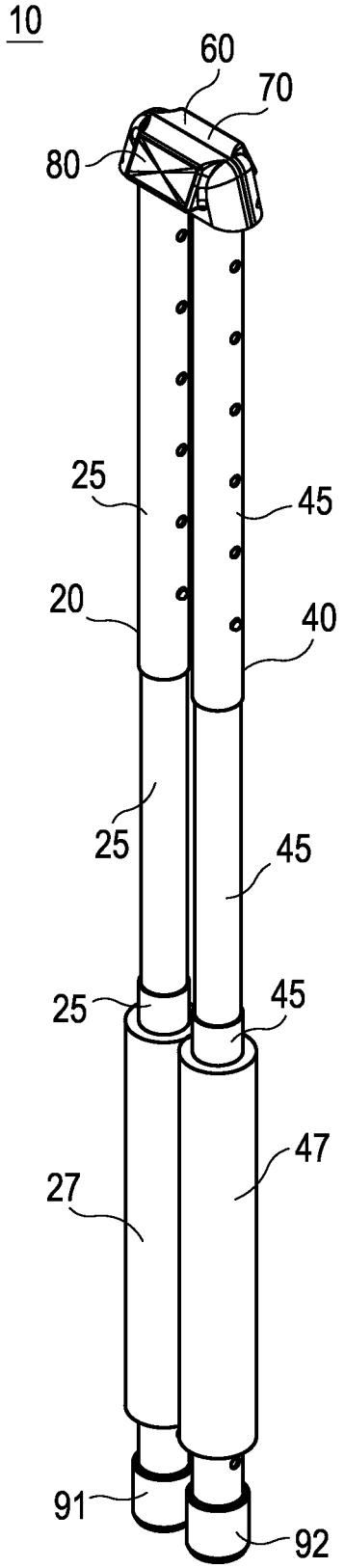
FIG. 1 is a perspective view of a health aid described herein in a closed position.

A health aid 10 for treating neck, shoulder and back pain is described herein. The apparatus and method may collectively be referred to herein as "the treatment." The treatment is directed to engagement of the health aid apparatus 10 with a user's trapezius muscles (T) in a practice that reduces, relieves, manages and/or eliminates the user's neck, shoulder and back pain. As used herein, the phrase "trapezius muscles" refers to the muscles located in the area at the juncture of the neck and shoulder, including the trapezius, and specifically the upper trapezius, and the levator scapulae muscles.

The terminology used herein is for the purpose of describing particular embodiments only and is not intended to be limiting of the invention. As used herein, the singular forms "a," "an" and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising."

As shown in FIGS. 1-13, the health aid 10 for treating neck, shoulder and back pain includes a first elongated member 20, a second elongated member 40, and an attachment 60 connecting the first and second elongated members 20, 40. The attachment 60 can be configured for the first and second elongated members 20, 40 to move between an open position as shown in FIG. 4A and an engaged position as shown in FIG. 4B.

Figure 12A:
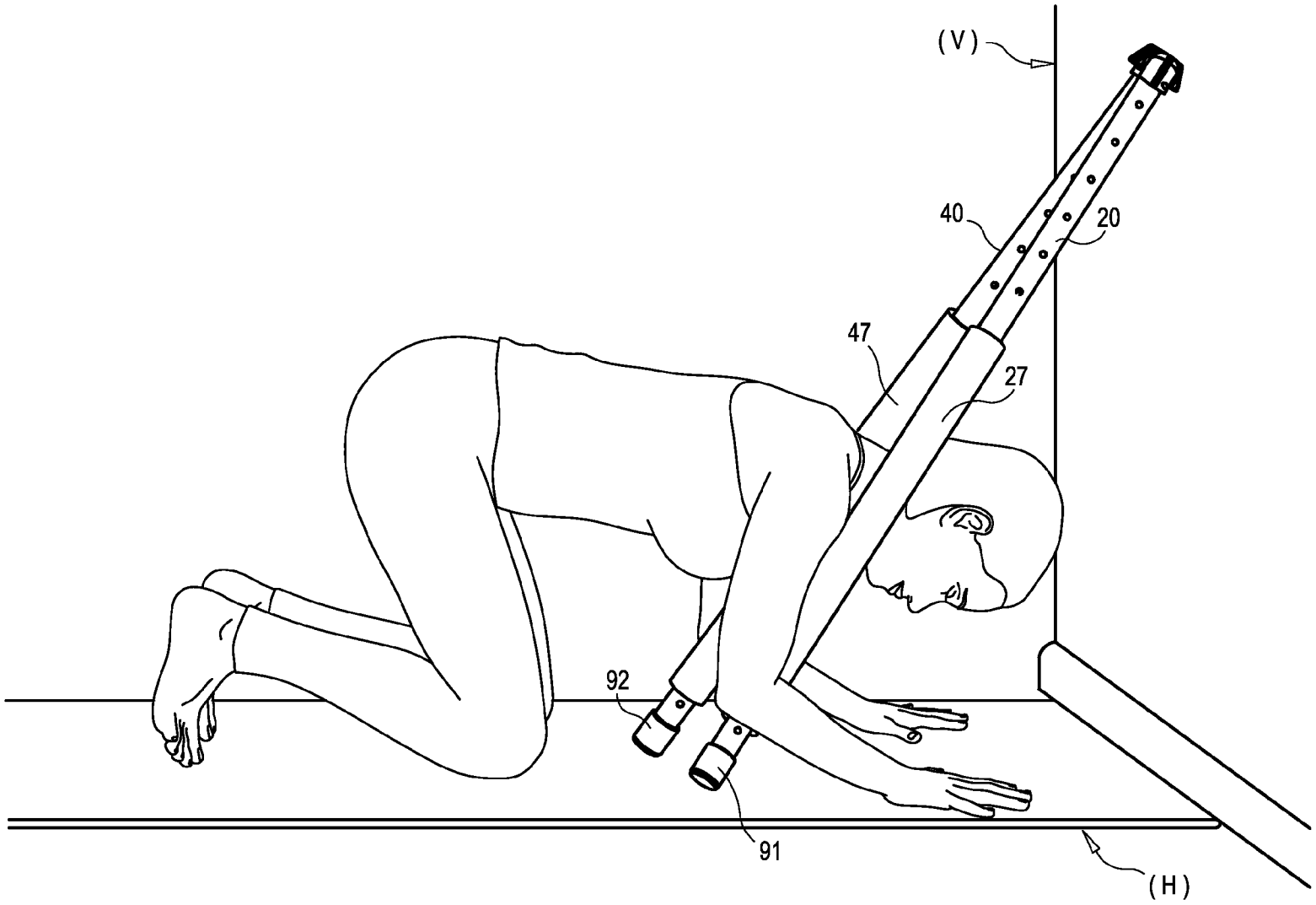
FIG. 12A is a perspective view of a user with a health aid described herein in an open position.

As used herein, the terms "top," "bottom," "upper" and "lower" refer to the vertical direction when the apparatus is resting on its feet as shown in FIG. 1. In the open position, a bottom end 21 of the first elongated member 20 and a bottom end 41 of the second elongated member 40 can be separated by a first distance (D1). The first distance (D1) can provide for a width between the lower portions of the elongated members 20, 40 such that a user's head can pass between the lower portions of the first and second elongated members 20, 40. For example, the first distance (D1) can include at least 5 inches, at least 6 inches, at least 8 inches, about 10-15 inches, less than 1.5 feet, or less than 2 feet. A user can be able to insert his head through the elongated members as shown in FIG. 12A.

In the engaged position, the bottom ends 21, 41 of the first and second elongated members 20, 40 can be separated by a second distance (D2) that is less than the first distance (D1), i.e. in the engaged position the first and second elongated 20, 40 are brought closer together than in the open position. The second distance (D2) can provide for a width between the lower portions of the elongated members 20, 40 that approximates the width of a users' neck. For example in the engaged position, one of the elongated members 20/40 can abut or otherwise be located near a right side of a user's neck and the other elongated member 40/20 can abut or otherwise be located near a left side of a user's neck. In another arrangement in the engaged position, one of the elongated members 20/40 can abut or otherwise be located near a right-side juncture of a user's neck and shoulder and the other elongated member 40/20 can abut or otherwise be located near a left-side juncture of a user's neck and shoulder.

Figure 2:
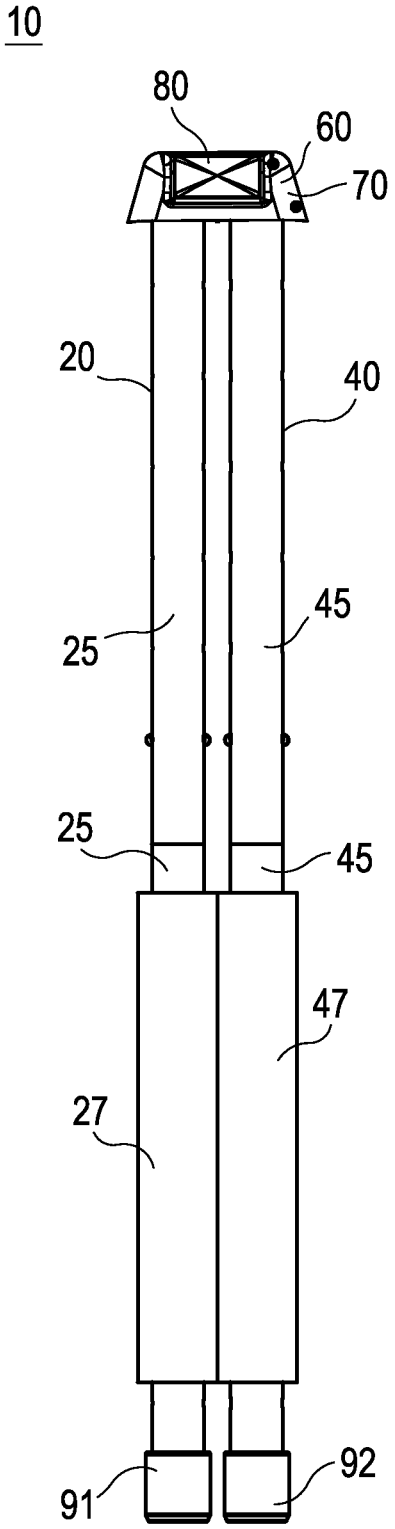
FIG. 2 is a front view of another health aid described herein in a closed position.

The health aid 10 can also include a closed position as shown in FIGS. 1 and 2. In the closed position, the bottom ends 21, 41 of the first and second elongated members 20, 40 can be substantially adjacent and the first elongated member 20 can be generally parallel to the second elongated member 40. The closed position can provide a configuration for easier storage and transport of the health aid 10 when not in use.

The first and second elongated members 20, 40 can include a circular or polygonal cross-section. Each of the first and second elongated members 20, 40 can include a single element forming the elongated member 20/40 or multiple elements. The multiple elements can also be removably attachable to form the elongated member 20/40. Each of the first and second elongated members 20, 40 can also be telescoping. The first elongated member 20 can include at least two first telescoping elements 25 and the second elongated member 40 can include at least two second telescoping elements 45. For example as shown in FIG. 2, each of the first and second elongated members 20, 40 can include two telescoping elements 25, 45. Or as shown in FIG. 1, each of the first and second elongated members 20, 40 can include three telescoping elements 25, 45. The removably attachable and/or telescoping elements can be connected with various fasteners, including without limitation, retractable buttons and holes, pins and holes, compression couplings, and other similar fasteners.

The telescoping elements 25, 45 can be in an expanded position as shown in FIGS. 1-4B when the health aid is in use.

Figure 5:
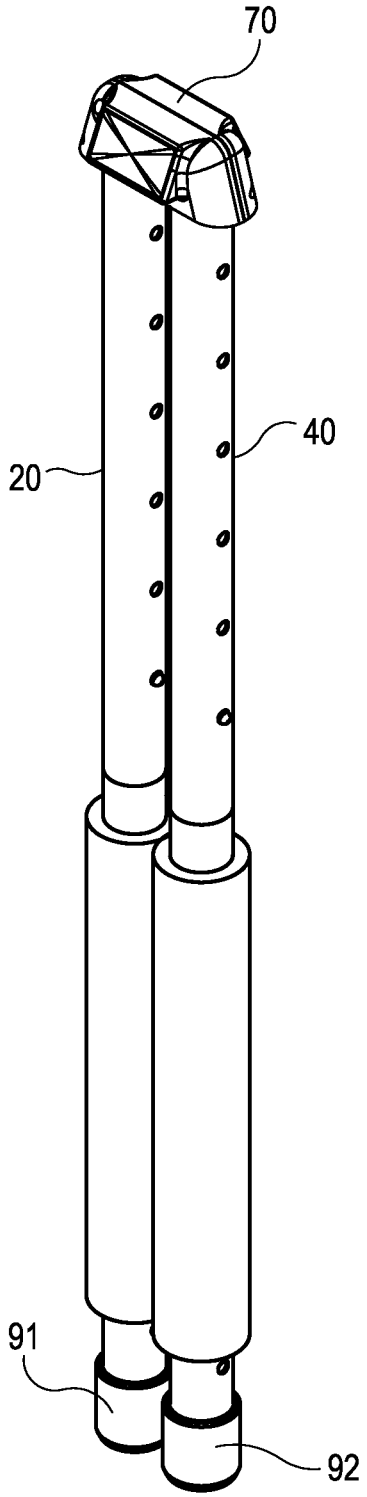
FIG. 5 is a perspective view of the health aid of FIG. 1 in a collapsed and closed position.

The telescoping elements 25, 45 can also be in various states of collapse. At least a portion of the telescoping elements 25, 45 can be partially or fully collapsed in order to selectively adjust the length of each elongated member 20, 40. The telescoping elements 25, 45 can also be in a collapsed position such that all of the telescoping elements 25, 45 can be fully collapsed. In particular, the elongated members 20, 40 can be arranged in a collapsed and closed position as shown in FIG. 5 for even easier storage and transport of the health aid 10.

The first and second elongated members 20, 40 can also include cushioning pieces 27, 47 in the areas where the elongated members 20, 40 are generally intended to engage with a user's neck and shoulders. As shown in FIGS. 1-5, 8 and 9, a first cushioning piece 27 can be connected to a bottom portion of the first elongated member 20 and a second cushioning piece 47 connected to a bottom portion of the second elongated member 40. The cushioning pieces 27, 47 can cover at least a portion of the bottom portions of the engagement members 20, 40. The cushioning pieces 27, 47 can also be moveable (e.g. slidable) along the respective elongated members 20, 40. The cushioning pieces 27, 47 can also be removeable.

Figure 6:
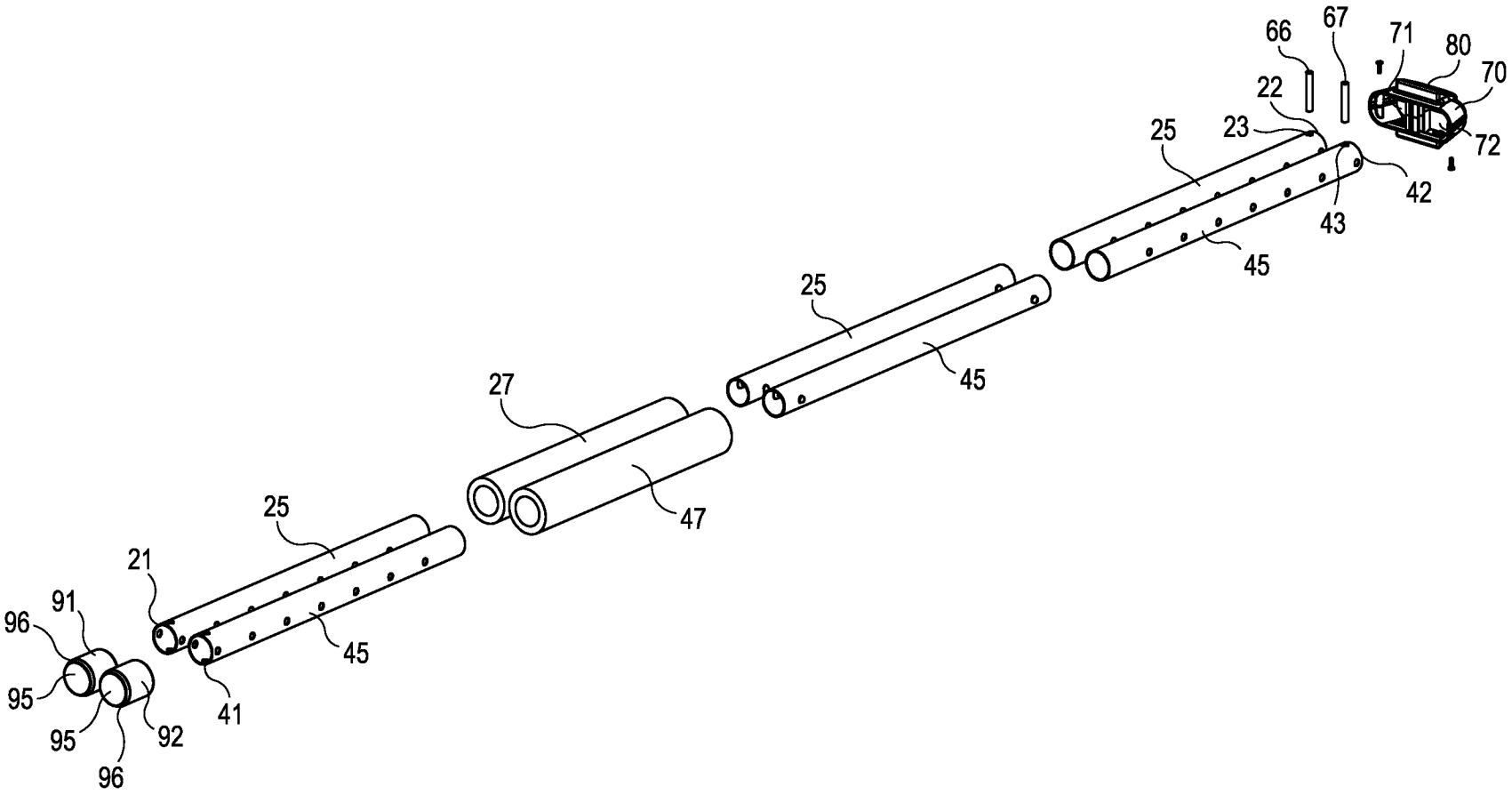
FIG. 6 is an exploded view of the health aid of FIG. 1.
Figure 8:
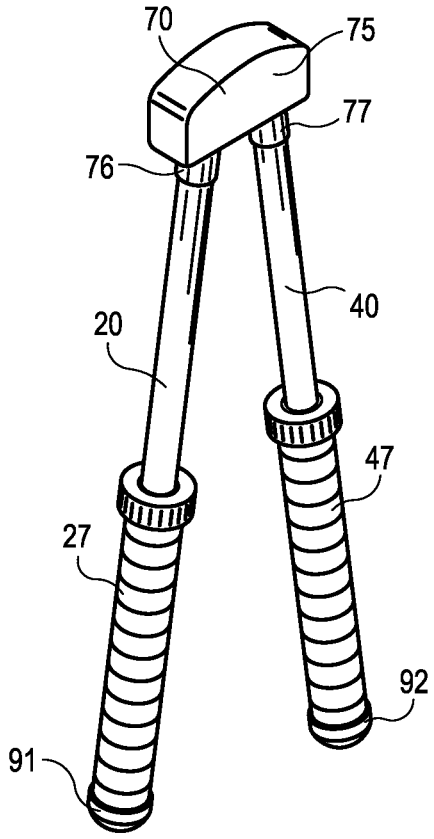
FIG. 8 is a perspective view of another health aid described herein.
Figure 9:
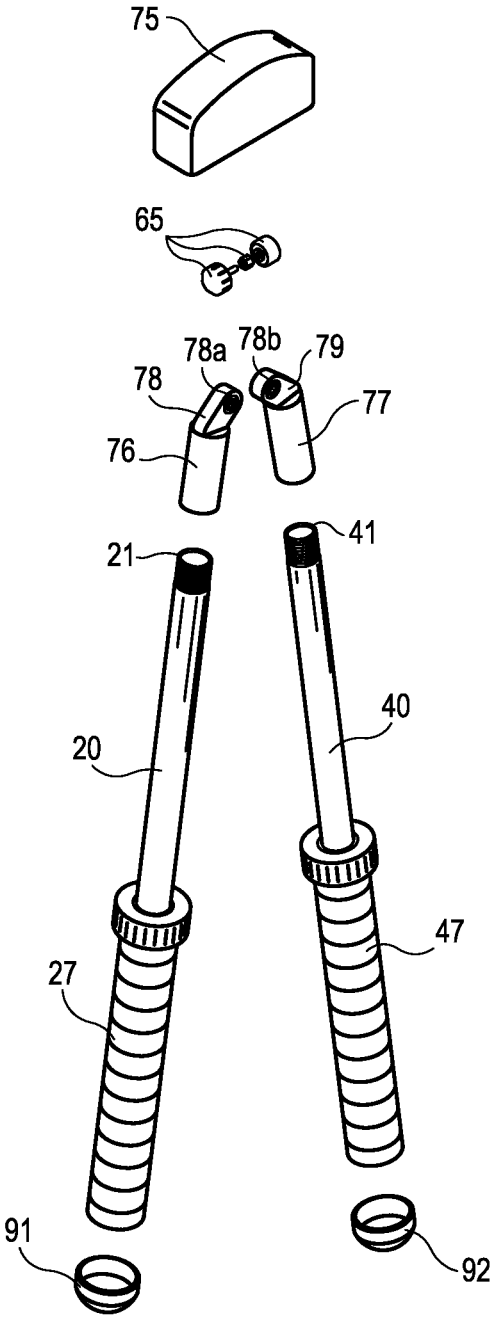
FIG. 9 is an exploded view of the health aid of FIG. 8.

The attachment 60 can connect the first and second elongated members 20, 40 at corresponding locations on each member 20, 40 including on a middle portion of each elongated member 20, 40 or on an upper portion of each elongated member 20, 40. In one arrangement as shown in FIGS. 1 and 6, the attachment 60 can connect the first and second elongated members 20, 40 proximate a top end 22, 42 of each of the elongated members 20, 40. The attachment 60 can also connect the first and second elongated members 20, 40 at the top end 22, 42 of each elongated member 20, 40 as shown in FIGS. 8 and 9.

Figure 3:
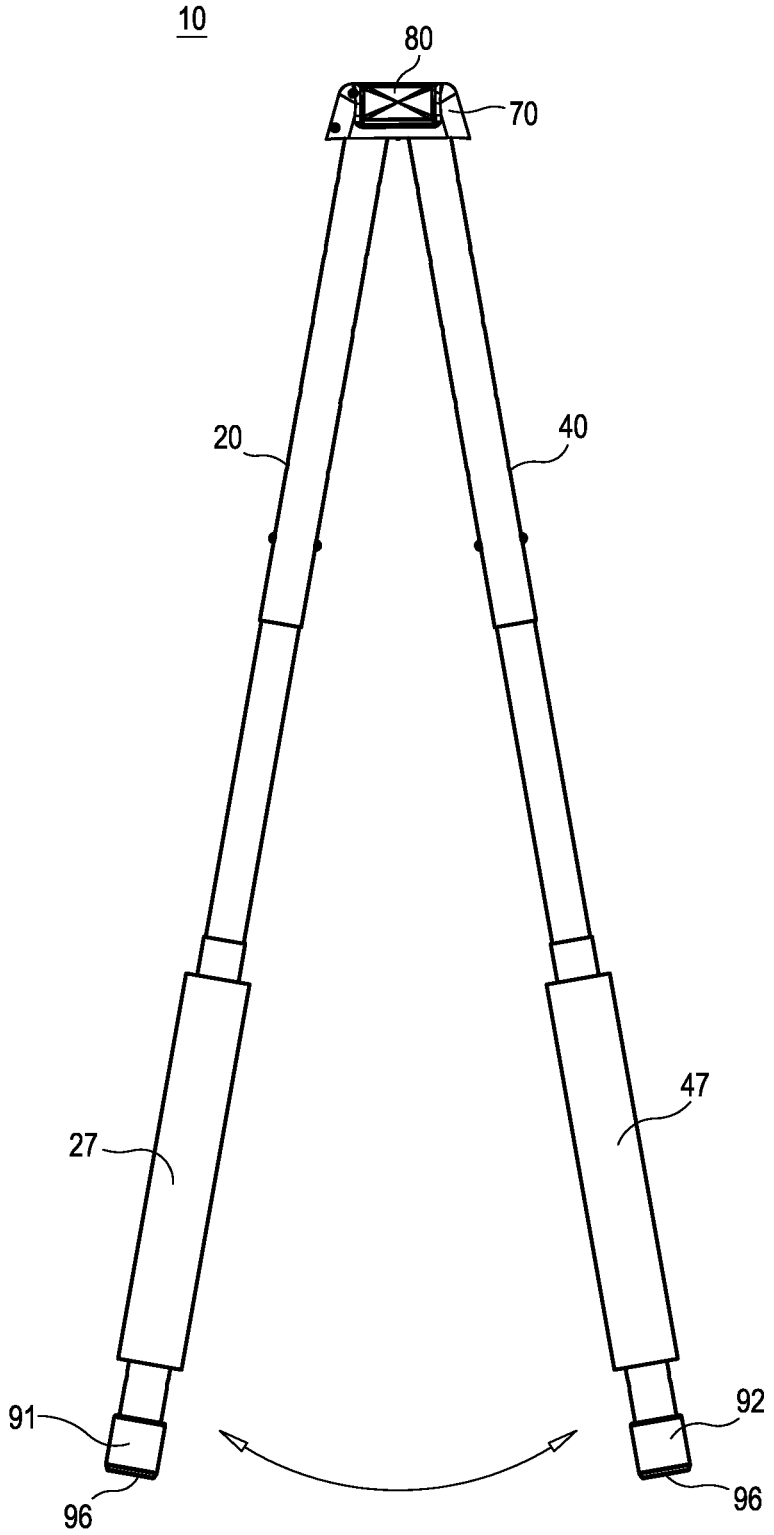
FIG. 3 is a front view of the health aid of FIG. 1.
Figure 4A:
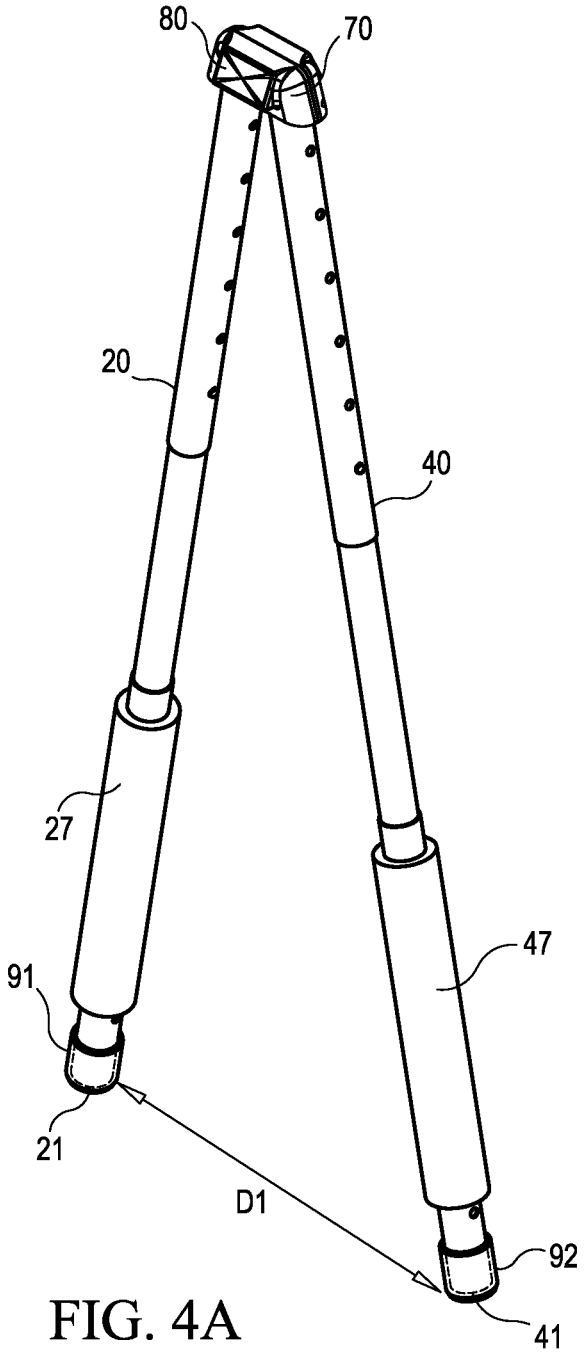
FIG. 4A is a perspective view of the health aid of FIG. 1 in an open position.
Figure 4B:
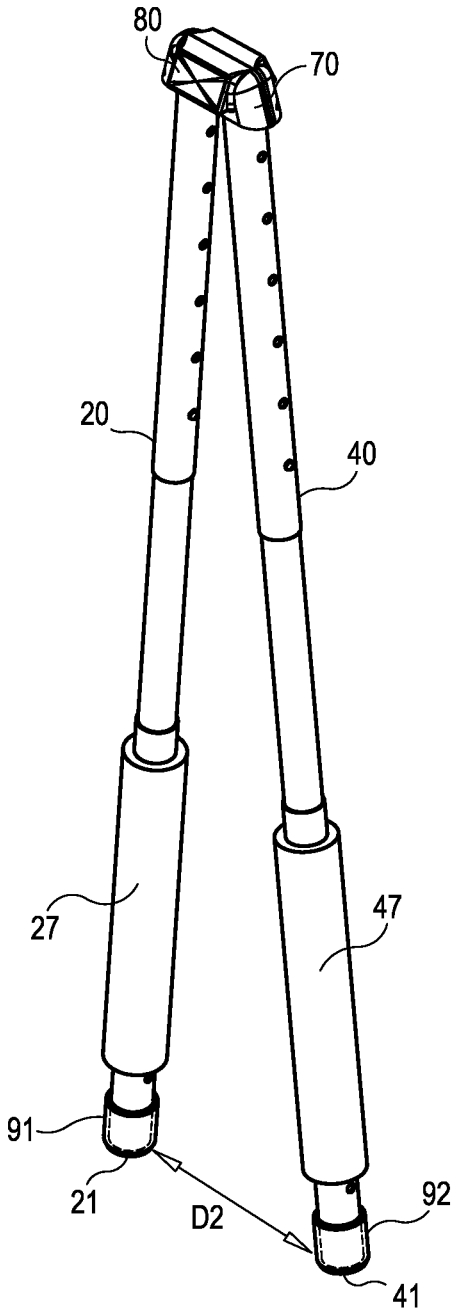
FIG. 4B is a perspective view of the health aid of FIG. 1 in an engaged position.

The attachment 60 can be a pivotal attachment configured such that the elongated members 20, 40 can move as shown in FIG. 3 between at least the first position and second position. For example, the pivotal attachment 60 can include a hinge, a screw or similar fastener, or a pin. The attachment 60 can include one pivotal attachment for both of the elongated members 20, 40 or separate pivotal attachments for each of the elongated members 20, 40.

For example in one arrangement, the attachment 60 can include a fastener passing through each of the first and second elongated members 20, 40, directly connecting the first elongated member 20 to the second elongated member 40 and allowing each elongated member 20, 40 to pivot about the axis of the fastener 60.

As shown in FIGS. 1-9, the attachment 60 can also include a cap 70 for connecting to the first elongated member 20 and the second elongated member 40. The cap 70 can include a first elongated member receiving portion 71 and a second elongated member receiving portion 72. The first elongated member receiving portion 71 can engage with the first elongated member 20 proximate a top end 22 of the first elongated member 20. The second elongated member receiving portion 72 can engage with the second elongated member 40 proximate a top end 42 of the second elongated member 40. The first and second elongated member receiving portions 71, 72 can also extend from an inside of the cap 70.

In one arrangement as shown in FIGS. 8 and 9, the cap 70 can include a housing 75 and at least two swivels 76, 77 for receiving the elongated members 20, 40. The swivels 76, 77 can be pivotably attached to the housing 75 proximate a top end of each swivel 76, 77, and the bottom end of each swivel 76, 77 can receive a top end 21, 41 of an elongated member 20, 40. For example, the swivel 76, 77 and elongated member 20, 40 can engage via corresponding threading, pins and holes, retractable buttons and holes, and other similar fasteners. The top end of each swivel 76, 77 can also include a sloped portion 78, 79 with an orifice 78*a*, 79*a*. A fastener 65, including without limitation a bolt and nut, pin, or flanged fasteners, can connect the swivels 76, 77 to the housing 75 via the orifices 78*a*, 79*a*. One fastener 65 can be used to connect both orifices 78*a*, 79*a* to the housing 75 or separate fasteners can be used to connect each orifice 78*a*, 79*a* of each swivel 76, 77 to the housing 75.

Figure 7:
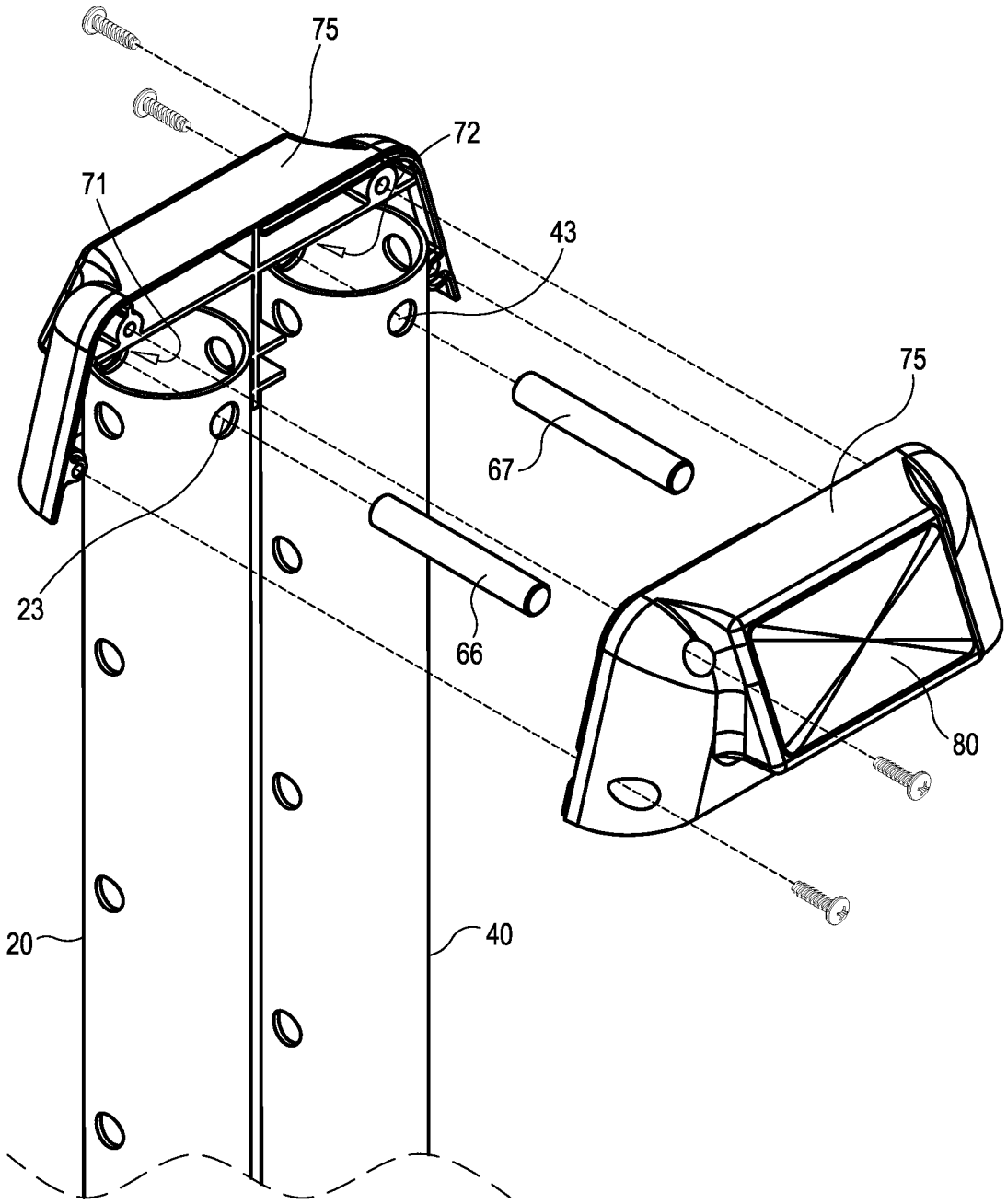
FIG. 7 is a partial exploded view of the top portion of the health aid of FIG. 1.

In another arrangement as shown in FIGS. 6 and 7, the cap 70 can include a housing 75 and pins 66, 67. The first elongated member 20 can include a first aperture 23 proximate the top end 22 of the first elongated member 20 and the second elongated member 40 can include a second aperture 43 proximate the top end 42 of the second elongated member 40. At least two pins 66, 67 can be arranged on an inside of the housing 75 and the first pin 66 can be received through at least a portion of the first aperture 23. The second pin 67 can be received through at least a portion of the second aperture 43. The first pin 66 can also extend laterally across a first half of the inside of the housing 75 and the second pin 67 can extend laterally across the second half as shown in FIG. 7.

The cap 70 can also include at least one resting face 80 for engagement with a substantially vertical surface (V). The resting face 80 can extend from or along an outside of the cap 70. The resting face 80 can be included on a first longitudinal side of the cap 70. Another resting face 80 can also be included on the second longitudinal side of the cap 70, i.e. a resting face 80 can be included on each side of the cap 70.

Figure 10:
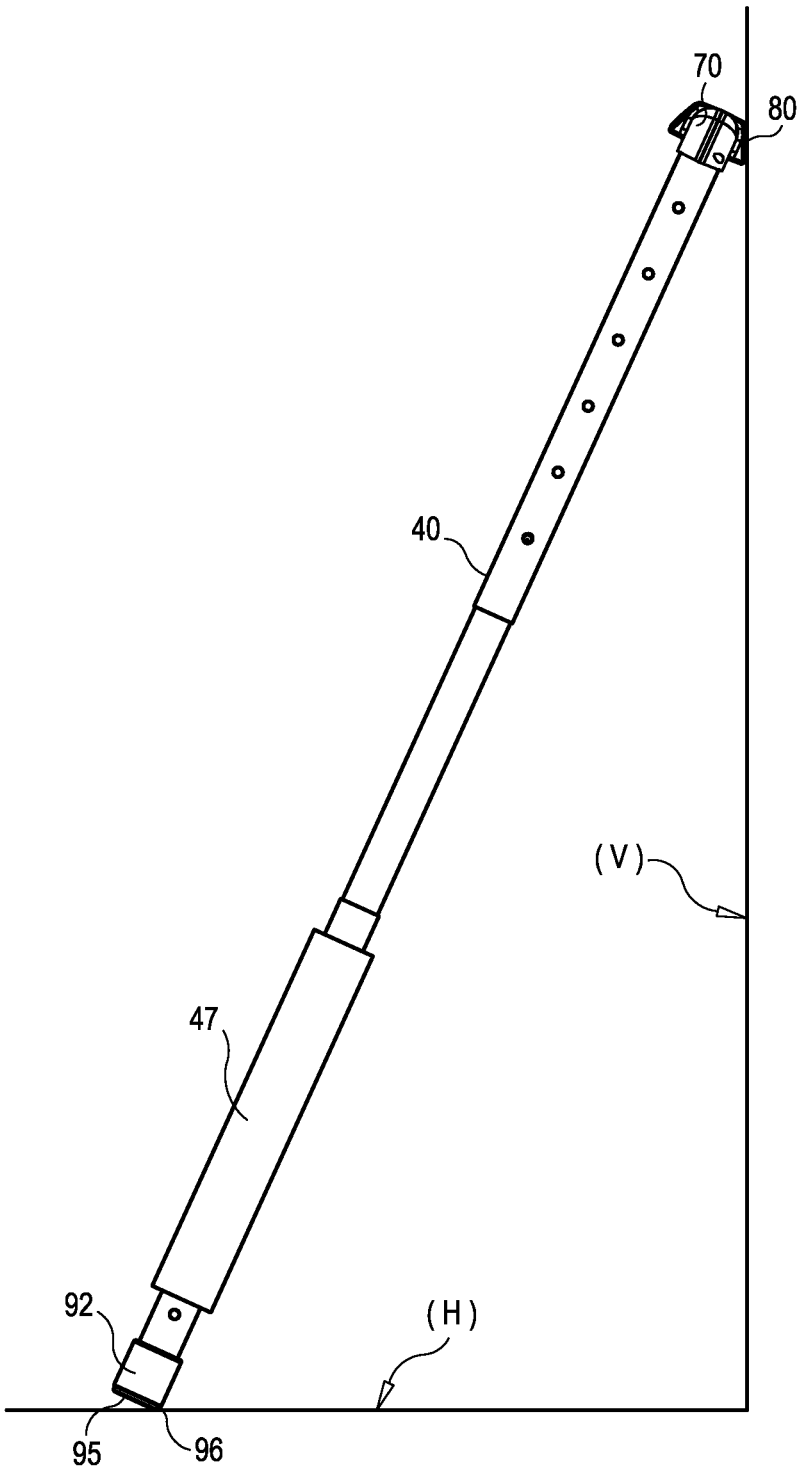
FIG. 10 is a side view of the health aid of FIG. 1 arranged at an angle.

As shown in FIGS. 1 and 7, the resting face 80 can also be angled with respect to a vertical axis of the health aid 10. The angled resting face 80 can be configured such that when the health aid 10 is arranged at a certain angle between a vertical surface (V) and horizontal surface (H), the resting face 80 of the cap 70 can rest against the vertical surface (V) as shown in FIG. 10. The resting face 80 can also include non-marking materials to reduce or prevent marks on a surface due to contact with the health aid 10. The resting face 80 can also include padding. In one embodiment, the resting face can include a bubble label.

The health aid 10 can also include securing feet 91, 92 for further stabilizing the health aid 10 when in use. A first securing foot 91 can be connected to the bottom end 21 of the first elongated member 20 and a second securing foot 92 can be connected to the bottom end 41 of the second elongated member 40, as shown in FIG. 6. The securing feet 91, 92 can provide additional stability such as by friction when the bottoms of the elongated members 20, 40 engage with a surface. For example, the frictional coefficient for the securing feet 91, 92 on a surface can be greater than for the ends 21, 41 of the elongated members 20, 40 alone on the same surface. The securing feet 91, 92 can include materials such as rubber, plastic, microfibers, polymers, and similar non-slipping materials. The securing feet 91, 92 can also include non-marking materials to reduce or prevent marks on a surface due to contact with the health aid 10.

Each securing foot 91, 92 can include a bottom wall 95. The bottom wall 95 can be curved as shown in FIGS. 8 and 9 or include angled faces as shown in FIGS. 1-3. At least a portion of the bottom wall 95 can include a securing face 96 for engagement with a substantially horizontal surface (H) when the health aid 10 is arranged at a certain angle with the horizontal surface (H), such as in FIG. 10.

The securing face 96 can also include a corresponding angle to the resting face 80 on the cap 70. As used herein, the term "corresponding angles" refers to a configuration such that an angle of the securing face 96 that engages with the substantially horizontal surface (H) corresponds to an angle of the cap's resting face 80 that engages with the substantially vertical surface (V). For example, when the health aid 10 is arranged at a certain angle between a substantially vertical surface (V) and a substantially horizontal surface (H), the securing face 96 of the feet 91, 92 can engage with the horizontal surface (H) when the resting face 80 on the cap 70 engages with the substantially vertical surface (V) as shown in FIG. 10.

A method for treating neck, shoulder and back pain using the above-described health aid 10 is also described herein. The method can include providing a health aid 10, arranging the health aid 10 at an angle with respect to a substantially horizontal plane and, once arranged, moving the health aid 10 from the open position to the engaged position, and engaging the first and second elongated members 20, 40 of the health aid 10 against a user's trapezius muscles (T).

The step of arranging the health aid 10 at an angle can include an arrangement with the bottom end of each of the first and second elongated members 20, 40 (including securing feet 91, 92 if the securing feet are attached to the bottom ends) engaging with a substantially horizontal surface (H). In order to form the angle, a middle or upper portion of the health aid 10 can rest on a vertical or raised surface (V)/(R). The bottom ends of the elongated members 20, 40 can be arranged spaced apart from the vertical or raised surface (V)/(R). For example, the bottom ends can be at least 1 foot, about 1.5 feet, about 2-2.5 feet, about 3 feet, about 3.5 feet, or greater from the vertical or raised surface (V)/(R).

In one arrangement as shown in FIG. 10, a top end of the health aid 10 can engage with a substantially vertical surface (V). For example, the resting face 80 on the cap 70 can engage with the substantially vertical surface (V). A vertical surface (V) can be provided on any suitable structure or object including, without limitation, a wall or a door.

Figure 11:
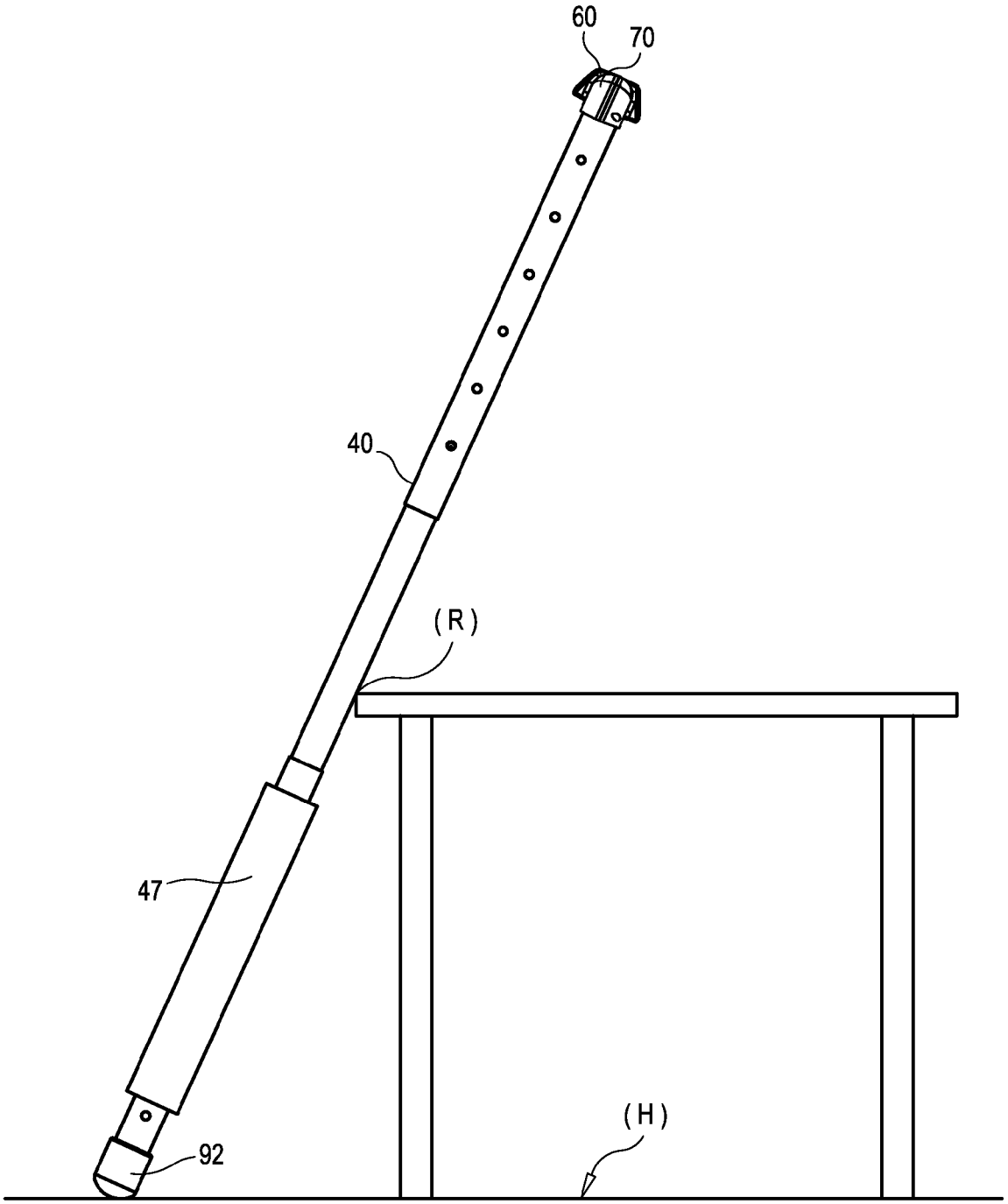
FIG. 11 is a side view of another health aid described herein arranged at an angle.

In another arrangement as shown in FIG. 11, an upper portion of the first and second elongated members 20, 40 can rest against a raised surface (R) to form an angle. As used herein, the term "raised surface" refers to a surface that is higher than the horizontal surface (H) such that the health aid 10 can form an angle with respect to the horizontal surface (H) when resting against the raised surface (R). A raised surface (R) can be provided on any suitable object or structure including, without limitation, a table, desk, chair, cabinet, or shelf.

Figure 12B:
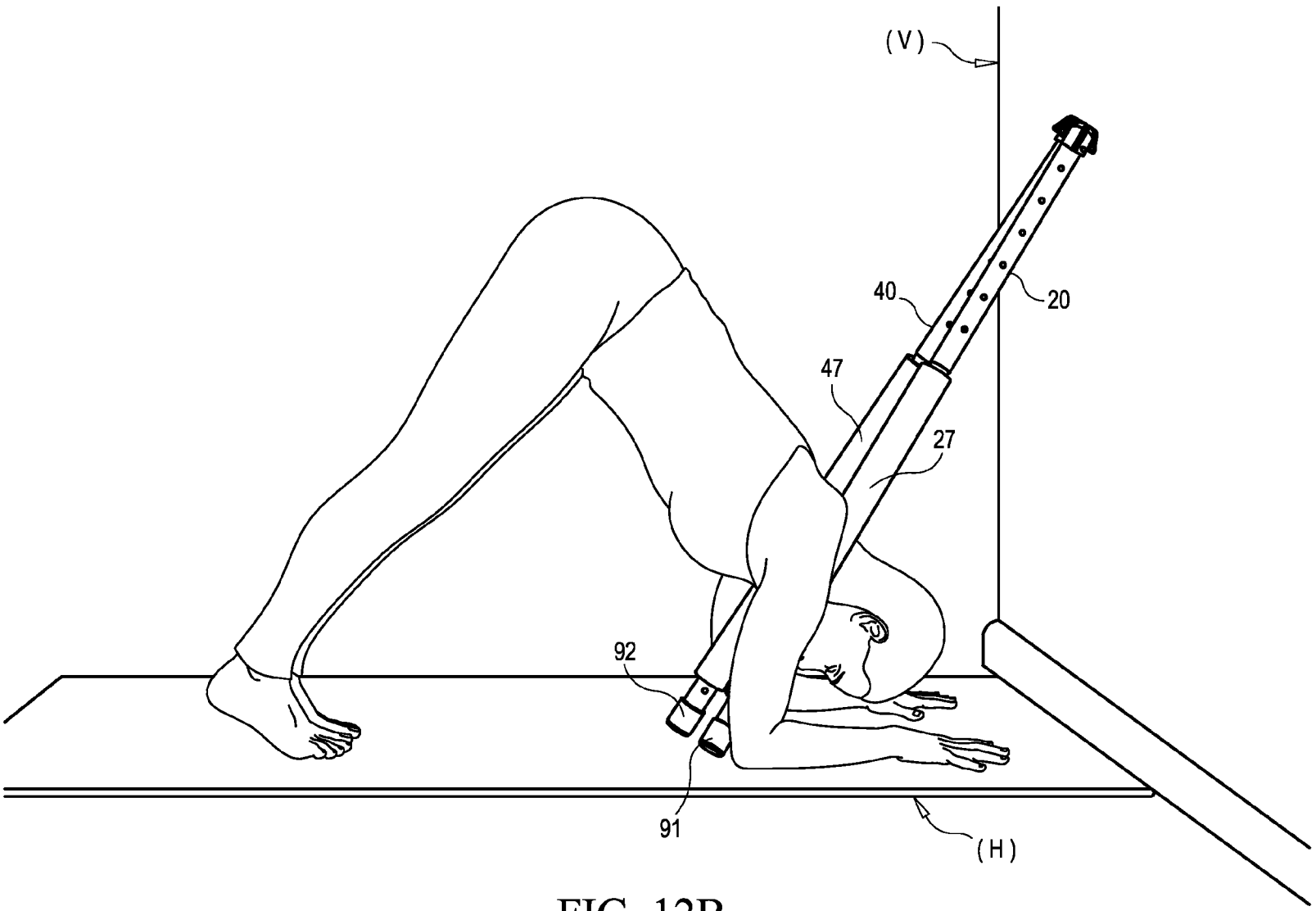
FIG. 12B is a perspective view of a user in a position with the health aid of FIG. 12A in an engaged position.
Figure 13:
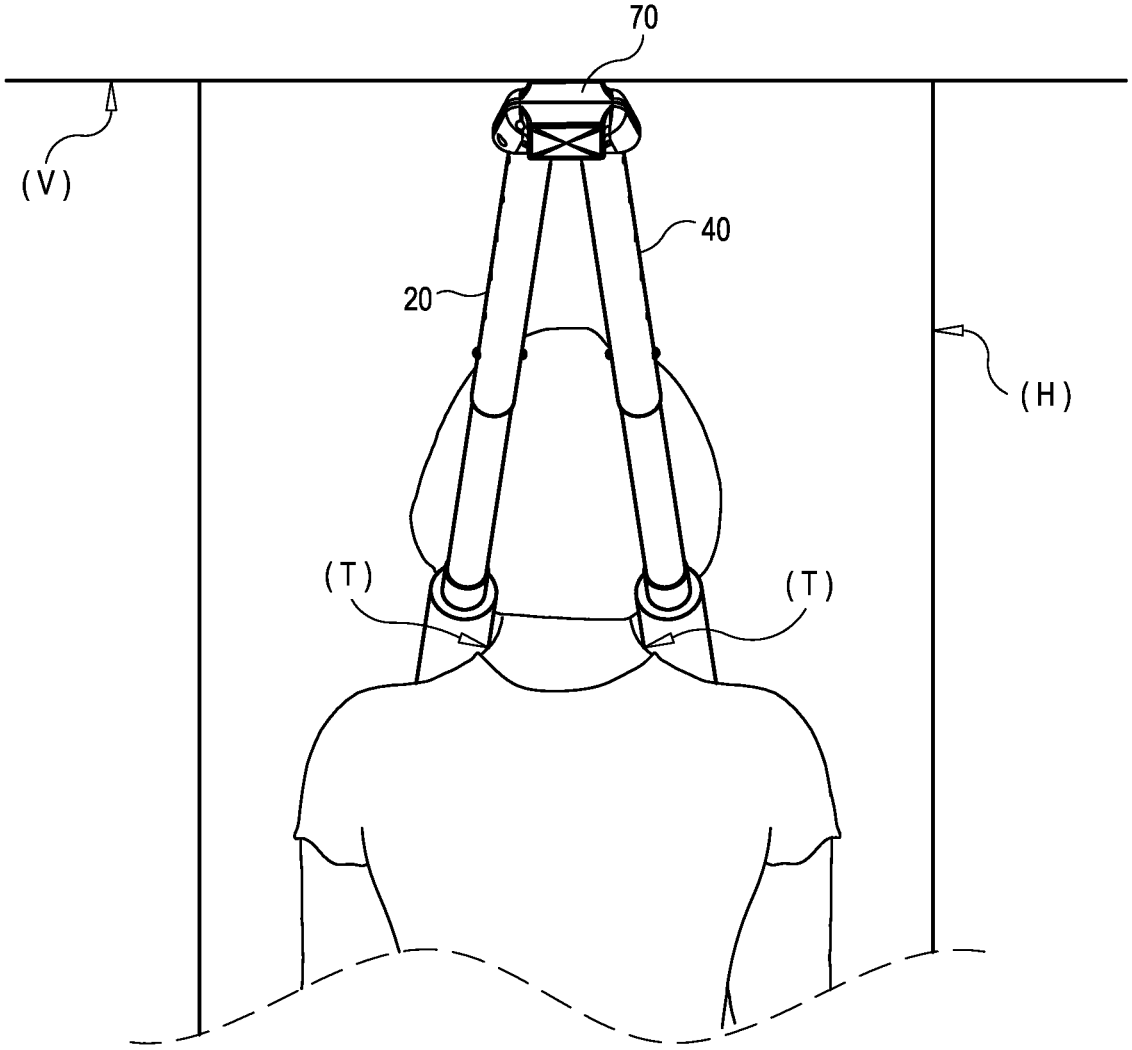
FIG. 13 is a partial top view of a user with the health aid of FIG. 12A in an engaged position.

The step of moving the health aid 10 from the open position to the engaged position can also include arranging the health aid 10 in the open position and inserting a user's neck between the first and second elongated members 20, 40 as shown in FIG. 12A, then moving the first and second elongated members 20, 40 closer together in the engaged position such that the first and second elongated members 20, 40 abut the user's trapezius muscles (T) as shown in FIGS. 12B and 13.

The step of engaging a user's trapezius muscles (T) can also include applying pressure to the trapezius muscles (T) and/or stretching the trapezius muscles (T) with the health aid 10. A user can also engage the health aid 10 to stretch his trapezius muscles (T) in a first direction. For example, the first and second elongated members 20, 40 can stretch the trapezius muscles (T) down the back towards the pelvis, e.g. by lifting the muscles in an upward or upwardly angled direction.

Figure 12C:
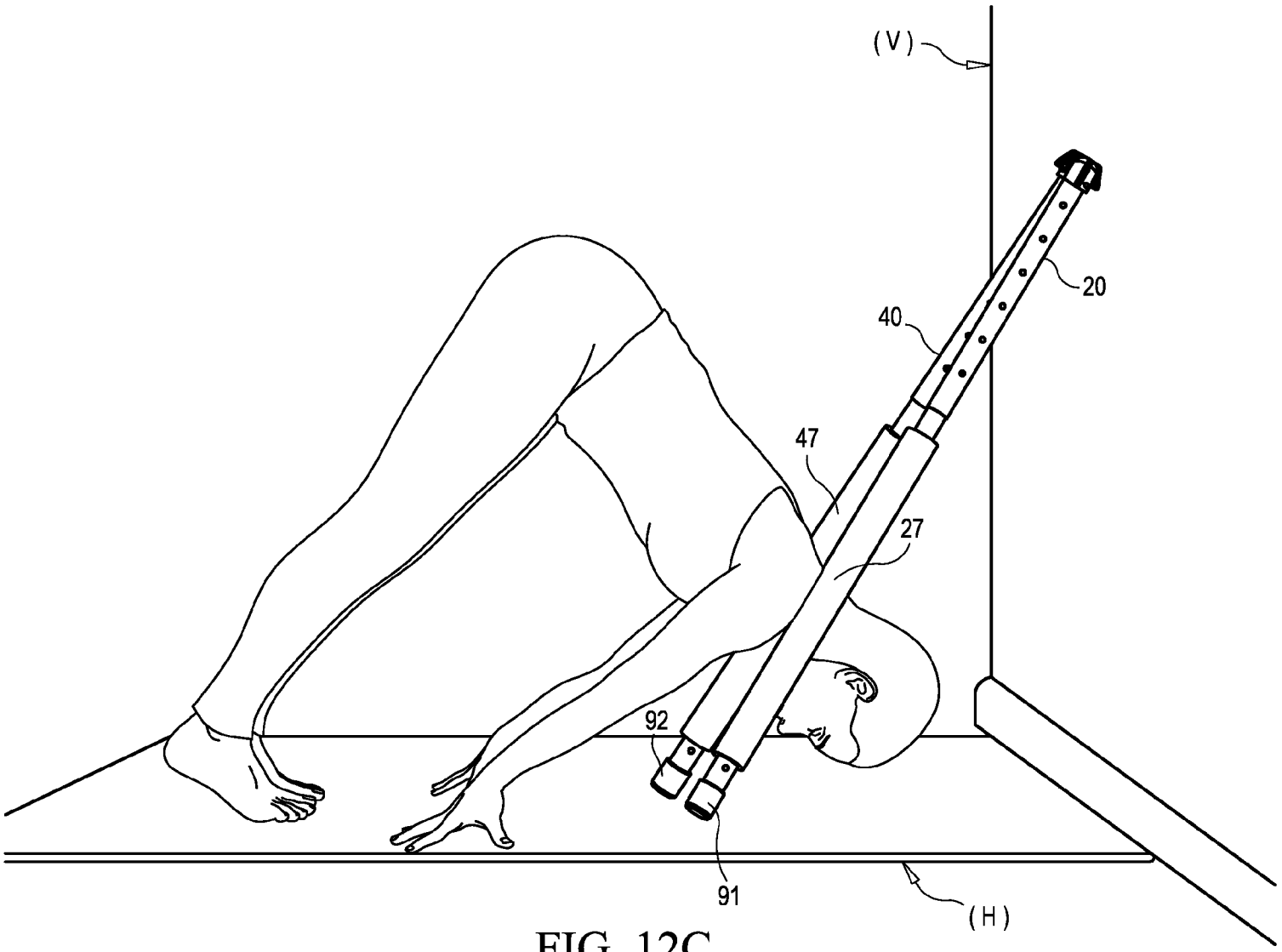
FIG. 12C is a perspective view of a user in another position with the health aid of FIG. 12A in an engaged position.

A user can also concurrently stretch his trapezius muscles (T) in a second direction that is substantially opposite to the first direction. For example, engaging the user's trapezius muscles (T) can include resting the first and second elongated members 20, 40 against the trapezius muscles (T) and forming an inverted position such that the user's head is suspended as shown in FIGS. 12B and 12C. In the suspended position, the user's head is released downward and gravity acts to gently traction the neck to concurrently stretch the trapezius muscles (T) in a downward or downwardly angled direction.

As used herein, the terms "suspended" and "suspending" refer to suspending a user's head above a surface such as a floor, e.g. the user's head does not rest on the surface. A user's head can be in a suspended position while other body parts, such as his feet or hands, can be in contact with the surface. Resting the first and second elongated members 20, 40 against a user's trapezius muscles (T) can also include resting the first elongated member 20 against the right trapezius muscles (T) and resting the second elongated member 40 against the left trapezius muscles (T).

In an exemplary application, a user can kneel down in front of the arranged health aid 10 and place his head between the elongated members 20, 40. The elongated members 20, 40 can then be moved closer together (i.e. toward his neck) into the engaged position, so that the elongated members 20, 40 touch the trapezius muscles (T). The user's forearms can be positioned around the outside of the elongated members 20, 40. The user can then lift his hips and lower his head to form an inverted position such that one or both of his feet are on the floor while his head is inverted. The forearms can rest on the floor if needed as shown in FIG. 12B, or be raised to hover just above the floor as shown in FIG. 12C, and preferably be raised throughout the practice of achieving and maintaining the inverted position. In this position, the user applies pressure to his trapezius muscles (T) with the health aid 10 using gravity and his own weight.

The treatment can also include holding this position, releasing the position, and repeating (i.e. holding and releasing again). For example, a user can repeat once or twice in the same session. A user can also reapply the treatment multiple times or at regular intervals. For example, the treatment can be reapplied multiple times during the day and/or multiple days during the week.

One advantage of the health aid and method is that the treatment can be administered at home or at other convenient locations such as at work, without further medical assistance, with an easy-to-use and economical device. The treatment can also allow a user to self-administer pain relief.

The health aid and method provide a pain relief treatment that targets and alleviates chronic tension in the neck and shoulder region and also in the lower back. The treatment can provide direct and steady pressure to the trapezius muscles, and specifically the treatment lifts the trapezius muscles up toward the hips while simultaneously allowing a steady downward traction of the neck. The treatment can also open the thoracic inlet for further health benefits including positive changes in posture, such as through reconstituting the lumbar curve of the spine. Furthermore, because the back is one holistic unit, when muscular tension in the upper back is reduced a "re-organization" occurs throughout the whole structure and lower back tension is diminished as well. In addition to neck, shoulder and back pain relief, other advantages can include reduction in the frequency and/or intensity of tension headaches, reduction of temporomandibular joint (TMJ) pain for TMJ issues that originate in the neck, restoration of the lumbar curve and improved posture.

EXAMPLES

In one instance, a patient experienced chronic tension in his neck and shoulders. Common stretches for this region proved ineffective. The patient used the health aid and method as described herein on a daily basis to target the exact region where tension presented. This treatment resulted in a significant reduction in the tension to the patient's neck and shoulder region and treatment over time kept most of the tension from returning. The patient described the result as feeling "lighter" in his neck.

In another instance, another patient experienced chronic pain in her neck, shoulders and lower back. The patient used the health aid and method described herein on a daily basis to her target neck and shoulder tension. The treatment resulted in the improvement, not only in the neck and shoulders, but also in her lower back.

In another instance, another patient experienced upper back tension due to poor posture. The patient used the health aid and method described herein on a weekly basis to target her upper back. Over time, the treatment resulted in significant improvement of the patient's posture and a reduction in the pain felt by patient in her upper back.

In another instance, another patient experienced neck pain and, when the tension in the neck was severe, TMJ or jaw pain also. The patient used the health aid and method described herein on a weekly basis to target the neck/shoulder region. The treatment resulted in a marked improvement in her neck and the TMJ pain diminished significantly.

In another instance, another patient had life-long neck issues from many falls during activities such as skiing, water skiing, etc. The patient used the health aid and method described herein on a weekly basis to target his neck/shoulder region. The treatment resulted in significant pain reduction felt by the patient, who enjoys the feeling of traction the health aid apparatus provides.

In another instance, another patient experienced neck and shoulder tension with frequent headaches. The patient used the health aid and method described herein on a daily basis to target the neck and shoulder region. The treatment resulted in a reduction of tension in the patient's neck and shoulders, and has directly helped to reduce the frequency of her headaches.

The foregoing is provided for purposes of illustrating, explaining, and describing embodiments of this invention. Modifications and adaptations to these embodiments will be apparent to those skilled in the art and may be made without departing from the scope or spirit of this invention.

The invention claimed is:

1. A method of treating neck, shoulder and back pain, comprising the steps of:

providing a health aid comprising:

a first elongated member, a second elongated member, and an attachment connecting said first and second elongated members and configured for the first and second elongated members to move between a closed position wherein a bottom end of each of said first and second elongated members are adjacent, an open position wherein said bottom ends are separated by a first distance and an engaged position wherein said bottom ends are separated by a second distance that is less than said first distance, and wherein said attachment comprises a cap having an angled resting face for engagement with a substantially vertical surface when the first and second elongated members are in the engaged position;

arranging said health aid at an angle with respect to a substantially horizontal plane; and, once arranged, moving said health aid from said open position to said engaged position; and engaging said first and second elongated members of said health aid against a user's trapezius muscles.

2. The method according to claim 1, said step of moving said health aid from said open position to said engaged position further comprising:

arranging said health aid in said open position;

inserting a user's neck between said first and second elongated members; and moving said first and second elongated members closer together wherein said first and second elongated members abut a user's trapezius muscles.

3. The method according to claim 1, said step of engaging a user's trapezius muscles further comprising stretching the trapezius muscles in a first direction and concurrently stretching the trapezius muscles in a second direction, wherein the second direction is substantially opposite the first direction.

4. The method according to claim 1, said step of engaging a user's trapezius muscles further comprising engaging said first elongated member against a user's right trapezius muscles and engaging said second elongated member against a user's left trapezius muscles wherein a user suspends his head in an inverted position.

5. The method according to claim 1, said step of arranging said health aid at an angle further comprising an arrangement wherein said resting face on said cap engages with a substantially vertical surface and said bottom end of each of said first and second elongated members engage with a substantially horizontal surface.

6. The method according to claim 5, wherein said substantially vertical surface comprises a wall and said substantially horizontal surface comprises a floor.

7. The method according to claim 5, wherein said cap of said health aid further comprises:

a first elongated member receiving portion inside said cap connected proximate to a top end of the first elongated member, and a second elongated member receiving portion inside said cap connected proximate to a top end of the second elongated member, and wherein said resting face extends from an outer longitudinal side of said cap; and said step of arranging said health aid at an angle further comprises engaging said resting face with said substantially vertical surface.

8. The method according to claim 1, said step of arranging said health aid at an angle further comprising an arrangement wherein an upper portion of said first and second elongated members rests against a raised surface and a bottom end of each of said first and second elongated members engages with a substantially horizontal surface.

* * * * *